US009608393B2

(12) United States Patent
Shirakawa et al.

(10) Patent No.: US 9,608,393 B2
(45) Date of Patent: Mar. 28, 2017

(54) REPEATER WITH TWO CONNECTORS MOUNTED ON TWO OPPOSITE SIDES OF A CIRCUIT BOARD

(71) Applicant: Hitachi Metals, Ltd., Tokyo (JP)

(72) Inventors: Yohei Shirakawa, Hitachi (JP); Koki Hirano, Hitachinaka (JP); Yoshitake Ageishi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/987,494

(22) Filed: Jan. 4, 2016

(65) Prior Publication Data

US 2016/0197425 A1 Jul. 7, 2016

(30) Foreign Application Priority Data

Jan. 7, 2015 (JP) ..... 2015-001610

(51) Int. Cl.

| | |
|---|---|
| ***H01R 12/00*** | (2006.01) |
| ***H01R 31/06*** | (2006.01) |
| ***H01R 12/59*** | (2011.01) |
| *H01R 13/6469* | (2011.01) |
| *H01R 24/64* | (2011.01) |

(52) U.S. Cl.

CPC ..... *H01R 31/06* (2013.01); *H01R 9/091* (2013.01); *H01R 12/592* (2013.01); *H01R 13/6469* (2013.01); *H01R 24/64* (2013.01)

(58) Field of Classification Search

USPC ..... 439/62, 63, 67, 78, 82

See application file for complete search history.

(56) References Cited

U.S. PATENT DOCUMENTS

| | | | | |
|---|---|---|---|---|
| 2007/0099455 | A1* | 5/2007 | Rothermel | H01R 12/585 439/108 |
| 2010/0285675 | A1* | 11/2010 | Weidner | H01R 24/50 439/65 |
| 2013/0280955 | A1* | 10/2013 | Alden, III | H01R 13/648 439/607.28 |
| 2016/0210824 | A1* | 7/2016 | Shirakawa | G08B 5/36 |

FOREIGN PATENT DOCUMENTS

| | | |
|---|---|---|
| JP | H 10-116667 A | 5/1998 |

* cited by examiner

*Primary Examiner* — Chandrika Prasad

(74) *Attorney, Agent, or Firm* — McGinn IP Law Group, PLLC.

(57) ABSTRACT

A repeater includes two connectors to each of which a communication cable is connected and a circuit board on which the two connectors are mounted and which includes a signal transmission section configured to connect corresponding ones of electrodes of the two connectors together, and the two connectors are mounted on different surfaces of the circuit board such that the communication cables are inserted in opposite insertion directions.

12 Claims, 2 Drawing Sheets

REPEATER WITH TWO CONNECTORS MOUNTED ON TWO OPPOSITE SIDES OF A CIRCUIT BOARD

The present application is based on Japanese patent application No. 2015-001610 filed on Jan. 7, 2015, the entire contents of which are incorporated herein by reference.

BACKGROUND OF THE INVENTION

1. Field of the Invention

The present invention relates to a repeater.

2. Description of the Related Art

In general, a repeater configured to connect communication cables together has been known.

As illustrated in FIG. 3, a known repeater 31 includes two connectors 32 and a circuit board 33 on which the two connectors 32 are mounted, and is configured to connect communication cables (not illustrated) each of which is connected to the corresponding one of the connectors 32 together. In the circuit board 33, a signal transmission section 34 that connects corresponding ones of electrodes (terminals) 35 of the two connectors 32 together is formed.

As the communication cables, in general, communication cables each of which has four pairs of signal lines through which a differential signal is transmitted and is provided with a plug connector including eight electrodes (terminals) at an end portion thereof so as to be integrated as one are used. Therefore, as the connectors 32, in general, jack connectors each of which includes the eight electrodes 35 are used.

An arrangement of the electrodes 35 of the jack connectors used as the connectors 32 is standardized by TIA/EIA-568-B defined by American National Standards Institute, and the like, and first and second ones, third and sixth ones, fourth and fifth ones, and seventh and eighth ones of the electrodes 35 are used as pairs. The signal transmission section 34 includes first to eighth main transmission channels 36 each of which connects ones of the electrodes 35 of the two connectors 32, which are numbered with the same number, together.

In the known repeater 31, the two connectors 32 having the same configuration are mounted on one (a lower surface in FIG. 2) of surfaces of the circuit board 33.

Note that Japanese Unexamined Patent Application Publication No. 10-116667 discusses related art.

SUMMARY OF THE INVENTION

However, in the known repeater 31, because the two connectors 32 are mounted on one of surfaces of the circuit board 33, ones of the electrodes 35 of the connectors 32, which are numbered with the same number, are not arranged in positions that are opposed to each other, wiring in the circuit board 33 is complicated, and the number of intersections of wirings is increased. Therefore, in the known repeater 31, a problem arises in which crosstalk between pairs is increased due to complexity of wiring.

Moreover, there is another problem in which, because the wiring in the circuit board 33 is complicated, a difference in electric channel length in the pairs may easily occur and a skew in the pairs may easily occur.

Because influences of crosstalk and a skew increase as the signal transmission speed increases, specifically, in a repeater used for high speed transmission, it is desired to minimize crosstalk and a skew.

It is therefore an object of the present invention to solve the above-described problems and provide a repeater that may reduce crosstalk and reduce the occurrence of a skew.

In order to achieve the above-described object, the present invention has been devised, and the present invention provides a repeater including two connectors each include electrodes, the two connectors configured to connect a communication cable and a circuit board on which the two connectors are mounted, the circuit board including a signal transmission section configured to connect corresponding electrodes of the two connectors together, and the two connectors are mounted on different surfaces of the circuit board such that the communication cables are inserted in opposite insertion directions.

The two connectors may have the same configuration.

The circuit board may include a flexible printed circuit board.

Each of the two connectors includes first and second electrodes, the first and second electrodes, the third and sixth electrodes, the fourth and fifth electrodes, and seventh and eighth electrodes may be used as pairs for transmitting a differential signal, the signal transmission section may include first to eighth linear main transmission channels each of which is configured to connect corresponding electrodes of the two connectors together, and the main transmission channels may be arranged such that the first, second, sixth, fourth, fifth, third, seventh, and eighth main transmission channels are disposed in this order.

Each of the two connectors includes first and second electrodes, the first and second electrodes, the third and sixth electrodes, the fourth and fifth electrodes, and seventh and eighth electrodes may be used as pairs for transmitting a differential signal, the signal transmission section may include first to eighth linear main transmission channels each of which is configured to connect corresponding electrodes of the two connectors together, and the main transmission channels may be arranged such that the second, first, third, fifth, fourth, sixth, eighth, and seventh main transmission channels are disposed in this order.

According to the present invention, a repeater that may reduce crosstalk and may reduce the occurrence of a skew may be provided.

BRIEF DESCRIPTION OF THE DRAWINGS

FIG. 1A is an exploded perspective view, and FIG. 1B is a side view illustrating the repeater when communication cables are connected thereto.

DESCRIPTION OF THE PREFERRED EMBODIMENTS

An embodiment of the present invention will be described below with reference to the accompanying drawings.

Figure 1A:
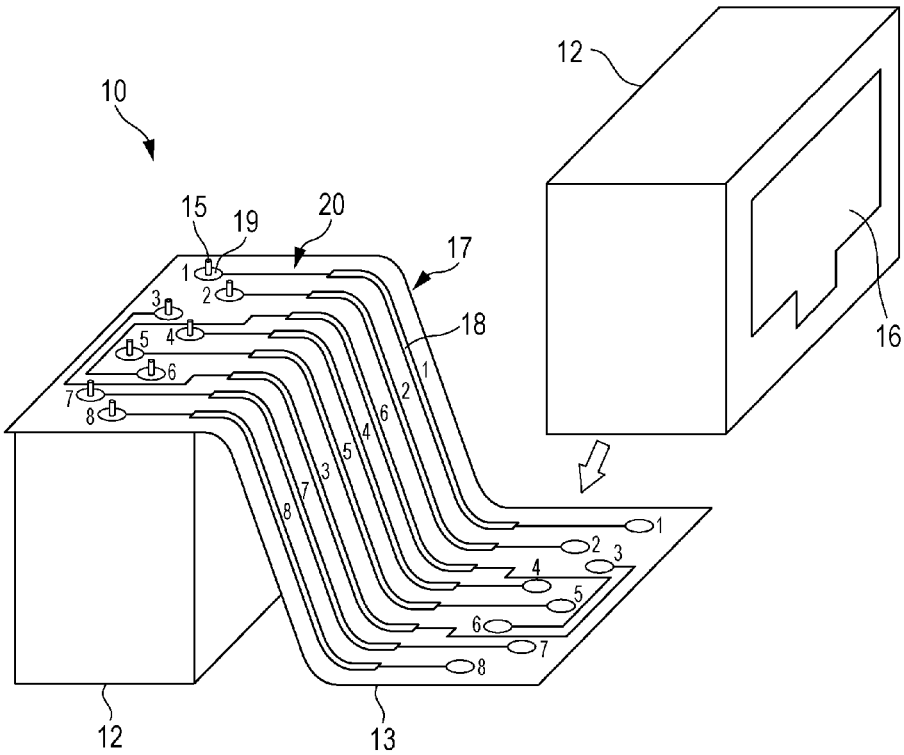
FIGS. 1A and 1B are views illustrating a repeater according to an embodiment of the present invention.
Figure 1B:
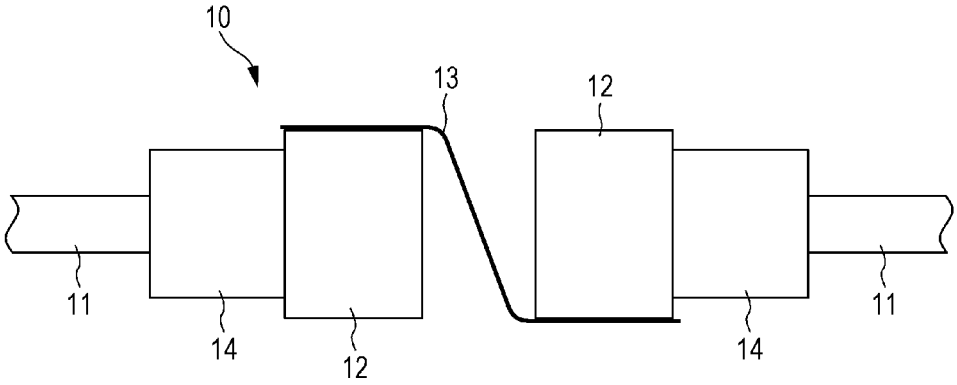

FIGS. 1A and 1B are views illustrating a repeater according to an embodiment of the present invention, FIG. 1A is an exploded perspective view, and FIG. 1B is a side view illustrating the repeater when communication cables are connected thereto.

As illustrated in FIGS. 1A and 1B, a repeater 10 includes two connectors 12 to each of which a communication cable 11 is connected and a circuit board 13 on which the two connectors 12 are mounted, and is configured to connect the communication cables 11 each of which is connected to the corresponding one of the two connectors 12 together.

As the communication cables 11, general-purpose local area network (LAN) cables may be used. In this embodiment, as the communication cables 11, cables each of which includes four pairs of signal lines (that is, eight signal lines in total) through which a differential signal is transmitted.

Each of the connectors 12 is, for example, a jack connector in compliance with the RJ45 standard, and is configured to be capable of connecting a connector 14 (for example, a plug connector in compliance with the RJ45 standard) provided in an end portion of the corresponding one of the communication cables 11.

Each of the connectors 12 includes eight electrodes (terminals) 15 that correspond to the eight signal lines of the corresponding one of the communication cables 11, and first and second ones, third and sixth ones, fourth and fifth ones, and seventh and eighth ones of the electrodes 15 are used as pairs for transmitting a differential signal.

An insertion hole 16 in which the connector 14 provided in the end portion of the corresponding one of the communication cables 11 is inserted is provided in a front surface of each of the connectors 12, and the electrodes 15 protrude from one side surface of the connector 12. In the following description, the up-down direction, the left-right direction, and the direction from the left front side to the right deep side in FIG. 1A are referred to as a height direction, a length direction, and a width direction, respectively.

In this embodiment, each of the connectors 12 is provided such that the first to eighth electrodes 15 are sequentially arranged at regular intervals in the width direction and protrude in the height direction. Although, in this case, ones of the electrodes 15, which are numbered with odd numbers, and ones of the electrodes 15, which are numbered with even numbers, are arranged at different positions in the length direction, ones of the electrodes 15, which are numbered with odd numbers, and ones of the electrodes 15, which are numbered with even numbers, may be arranged on a straight line in the same position in the length direction. By arranging ones of the electrodes 15, which are numbered with odd numbers, and ones of the electrodes 15, which are numbered with even numbers, at different positions in the length direction, connection work of connecting the electrodes 15 may be simplified, and thus, specifically, when small-size connectors are used as the connectors 12, connection work may be simplified.

In this embodiment, as the two connectors 12, connectors having the same configuration are used. Note that the present invention is not limited thereto but, as long as the same positional relationship of the electrodes 15 may be achieved, any connectors may be used as the two connectors 12.

The circuit board 13 includes a signal transmission section 17 configured to connect ones of the electrodes 15 of the two connectors 12, which correspond to each other, together. The signal transmission section 17 includes eight main transmission channels 18, that is, first to eighth main transmission channels 18, each having a linear shape (the shape of each of the main transmission channels 18 changes in accordance with the shape of the circuit board 13 when the circuit board 13 is curved), which correspond to the first to eighth electrodes 15 of each of the connectors 12, and a pad 19 that connects the corresponding one of the electrodes 15 is connected to the corresponding one of the main transmission channels 18 via a wiring section 20. Note that the reference characters 1 to 8 in FIG. 1A denote the numbers of the electrodes 15 (the pads 19) and the main transmission channels 18.

In the repeater 10 according to this embodiment, the two connectors 12 are mounted on different surfaces of the circuit board 13 such that the communication cables 11 are inserted in opposite insertion directions.

The two connectors 12 are mounted on both ends of the circuit board 13 in the length direction in a state where the two connectors 12 are in the up-down reverse relation and in the left-right reverse relation. One of the connectors 12 (on the left side in FIG. 1) is mounted on a back surface of the circuit board 13 and the other one of the connectors 12 (on the right side in FIG. 1) is mounted on a front surface of the circuit board 13. The two connectors 12 are mounted on the circuit board 13 such that the insertion directions of the communication cables 11 matches the length direction, and are fixed to the circuit board 13 by fixing each of the electrodes 15 to the corresponding one of the pads 19 by a solder or the like.

By mounting the two connectors 12 on different surfaces of the circuit board 13 such that the communication cables 11 are inserted in opposite insertion directions, for example, in FIG. 1A, each of the first electrodes 15 is arranged in a part of the corresponding one of the two connectors 12, which is located in the right deep side, each of the eighth electrodes 15 is arranged in a part of the corresponding one of the two connectors 12, which is located in the left front side, and thus, ones of the electrodes 15 of the two connectors 12, which correspond to each other, are arranged so as to be opposed to each other. As a result, wiring of the wiring section 20 may be simplified to reduce the number of intersections of wirings (or eliminate the intersections), so that crosstalk between pairs may be reduced.

Also, in this embodiment, as the circuit board 13, a flexible printed circuit board (FPC) is used. Because a FPC may be easily curved, the positions of the two connectors 12 in the height direction may be made match each other by curving the circuit board 13 into an approximately S shape when viewed from the side, and thus, the size of the entire repeater 10 may be reduced.

Furthermore, in this embodiment, the main transmission channels 18 of the signal transmission section 17 are arranged such that first, second, sixth, fourth, fifth, third, seventh, and eighth main transmission channels 18 are disposed in this order from one side (the right deep side in FIG. 1A) to the other side (the left front side in FIG. 1A) in the width direction.

According to standards, such as TIA/EIA-568-B and the like, defined by American National Standards Institute, first and second ones, third and sixth ones, fourth and fifth ones, and seventh and eighth ones of the main transmission channels 18 are used as pairs, and therefore, the pair of the fourth and fifth main transmission channels 18 is interposed between the pair of the third and sixth main transmission channels 18, resulting in increase in crosstalk caused by the influence of the pair of the third and sixth main transmission channels 18. Specifically, in the connectors 12 in which a distance between channels is small, the influence of crosstalk is increased, and this becomes a problem when the signal speed is increased.

Thus, in this embodiment, the positions of the third main transmission channel 18 and the sixth main transmission channel 18 are switched around, thereby canceling crosstalk that has occurred in the connectors 12. A current that is generated by the occurrence of crosstalk from the pair of the third and sixth main transmission channels 18 to another pair and a current that is generated by the occurrence of crosstalk from another pair to the pair of the third and sixth main transmission channels 18 are in an opposite-phase relationship in the connectors 12 and the main transmission channels 18 to be cancelled out, and consequently, crosstalk may be reduced.

Note that, in this case, the positions of the third main transmission channel 18 and the sixth main transmission channel 18 are switched around, but similar advantages may be achieved even by leaving the arrangement of the pair of the third and sixth main transmission channels 18 as it is and switching around the positions of another pair of the main transmission channels 18. In this case, the main transmission channels 18 are arranged such that the second, first, third, fifth, fourth, sixth, eighth, and seventh main transmission channels 18 are disposed in this order.

Figure 2:
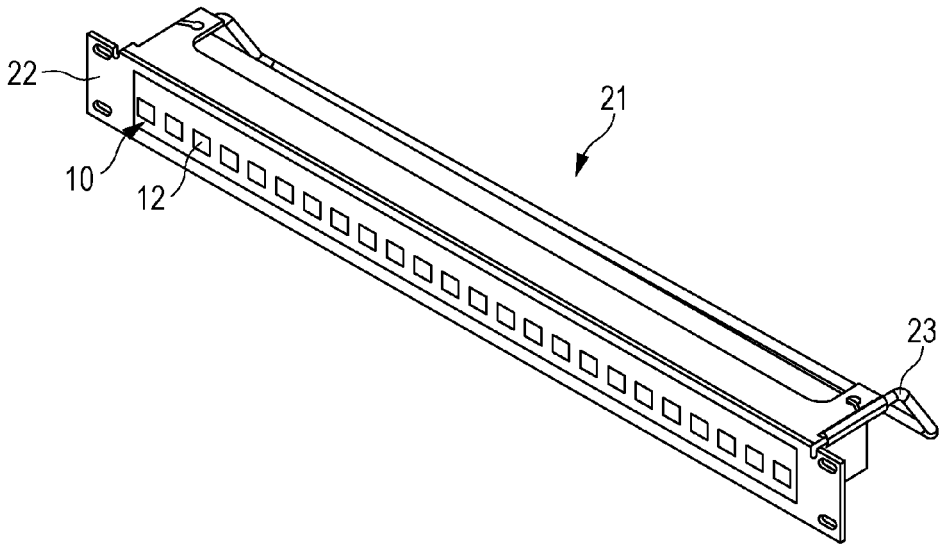
FIG. 2 is a perspective view of a repeater module using the repeater of FIG. 1.
Figure 3:
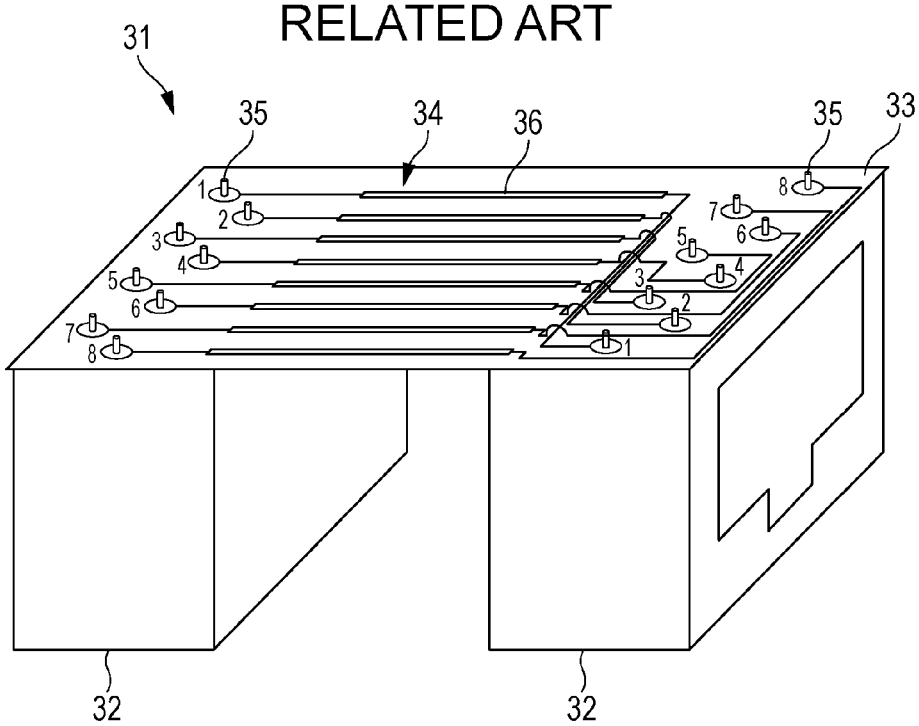
FIG. 3 RELATED ART
FIG. 3 is a perspective view of a known repeater.

In this case, a case where the repeater 10 is used as a single unit has been described, but, as illustrated in FIG. 2, a plurality of repeaters 10 may be arranged in an array to be modularized, thereby forming a repeater module 21.

In FIG. 2, a case where the repeater module 21 is attached to a front panel 22 having a 1U size, defined by IEC60917 (JIS C 6010), and a cable holder 23 is provided on a back surface side of the repeater module 21 so as to support the communication cables 11 which extend from the back surface side (that is, which are connected to the connectors 12 at the back surface side) from the bottom to reduce loads applied to connection portions that are connected with the communication cables 11 is described.

As has been described above, in the repeater 10 according to this embodiment, the two connectors 12 are mounted on different surfaces of the circuit board 13 such that the communication cables 11 are inserted in opposite insertion directions.

By configuring the repeater 10 in the above-described manner, ones of the electrodes 15 of the connectors 12, which correspond to each other, are arranged so as to be opposed to each other, so that the number of intersections of wirings in the circuit board 13 may be reduced, and thus crosstalk between pairs may be reduced.

Also, according to this embodiment, wiring in the circuit board 13 may be simplified, and therefore, the occurrence of a difference in electric channel length in the pairs may be reduced, and the occurrence of a skew in the pairs may be reduced.

The problem of crosstalk and a skew becomes more serious as the signal speed increases, and therefore, the repeater 10 according to this embodiment is suitable, specifically, for use in high-speed transmission. The repeater 10 may be preferably used in high-speed transmission, for example, at 1 Gbps or more, and furthermore, at 10 Gbps or more.

Furthermore, in this embodiment, as the two connectors 12, connectors having the same configuration are used, and therefore, the repeater 10 may be realized at low cost without increasing the number of members.

Also, in this embodiment, as the circuit board 13, a flexible printed circuit board is used, and thus, the circuit board 13 may be curved such that the positions of the connectors 12 in the height direction may be match each other, thus resulting in reduction in size of the repeater 10.

Furthermore, in this embodiment, the main transmission channels 18 are arranged such that first, second, sixth, fourth, fifth, third, seventh, and eighth main transmission channels 18 are disposed in this order, and thus, crosstalk related to the pair of the third and sixth main transmission channels 18 may be further reduced.

Needless to say, the present invention is not limited to the above-described embodiment, and various modifications may be made without departing from the gist of the present invention.

For example, in the above-described embodiment, a case where the two connectors 12 are mounted in the circuit board 13 has been described, but a plurality of sets of connectors 12 may be mounted on a common circuit board 13 to connect a plurality of sets of communication cables 11.

What is claimed is:

1. A repeater, comprising:

two connectors each comprising electrodes, the two connectors configured to connect a communication cable; and a circuit board on which the two connectors are mounted, the circuit board comprising a signal transmission section configured to connect corresponding electrodes of the two connectors together, wherein each of the two connectors comprises first to eighth electrodes, the first and second electrodes, the third and sixth electrodes, the fourth and fifth electrodes, and seventh and eighth electrodes being used as pairs for transmitting a differential signal, wherein the circuit board comprises a first set of first to eighth pads that connect corresponding first to eighth electrodes of one of the two connectors and a second set of first to eighth pads that connect corresponding first to eighth electrodes of another of the two connectors, wherein the first set of first to eighth pads and the second set of first to eighth pads are arranged in parallel and in a same order viewed from a same side of the circuit board, the signal transmission section comprising first to eighth linear main transmission channels each of which is configured to connect corresponding electrodes of the two connectors together, and wherein the two connectors are mounted on different surfaces of the circuit board such that a part of the communication cable connected to the one of the two connectors and another part of the communication cable connected to said another of the two connectors are inserted in opposite insertion directions.

2. The repeater according to claim 1, wherein the two connectors have a same configuration.

3. The repeater according to claim 1, wherein the circuit board comprises a flexible printed circuit board.

4. The repeater according to claim 1, wherein the main transmission channels are arranged such that the first, second, sixth, fourth, fifth, third, seventh, and eighth main transmission channels are disposed in this order.

5. The repeater according to claim 1, wherein the main transmission channels are arranged such that the second, first, third, fifth, fourth, sixth, eighth, and seventh main transmission channels are disposed in this order.

6. The repeater according to claim 1, wherein, when viewed from the same side of the circuit board, the first electrode of said one of the two connectors is connected to the first electrode of said another of the two connectors, and the eighth electrode of said one of the two connectors is connected to the eighth electrode of said another of the two connectors.

7. The repeater according to claim 1, wherein said one of the two connectors is mounted on a back surface of the circuit board, and said another of the two connectors is mounted on a front surface of the circuit board.

8. The repeater according to claim 1, wherein, when viewed from a side of the repeater, the circuit board is curved between the two connectors such that the circuit board has an S shape.

9. The repeater according to claim 1, wherein first and second ones of the main transmission channels, third and sixth ones of the main transmission channels, fourth and fifth ones of the main transmission channels, and seventh and eighth ones of the main transmission channels are used as pairs.

10. The repeater according to claim 9, wherein the pair of the fourth and fifth ones of the main transmission channels is interposed between the pair of the third and sixth ones of the main transmission channels.

11. The repeater according to claim 1, wherein a pair of the fourth and fifth ones of the main transmission channels is interposed between a pair of the third and sixth ones of the main transmission channels.

12. The repeater according to claim 1, wherein, when viewed from the same side of the circuit board, said one of the two connectors has a same configuration as said another of the two connectors.

* * * * *